US009440712B2

(12) United States Patent
Bougault et al.

(10) Patent No.: US 9,440,712 B2
(45) Date of Patent: Sep. 13, 2016

(54) TANK WALL COMPRISING A THROUGH-ELEMENT

(71) Applicant: GAZTRANSPORT ET TECHNIGAZ, Saint Remy les Chevreuse (FR)

(72) Inventors: Johan Bougault, Jouy en Josas (FR); Sebastien Durand, Boullay (FR)

(73) Assignee: GAZTRANSPORT ET TECHNIGAZ, Saint Remy les Chevreuse (FR)

( * ) Notice: Subject to any disclaimer, the term of this patent is extended or adjusted under 35 U.S.C. 154(b) by 0 days.

(21) Appl. No.: 14/767,860

(22) PCT Filed: Feb. 11, 2014

(86) PCT No.: PCT/FR2014/050265

§ 371 (c)(1),
(2) Date: Aug. 13, 2015

(87) PCT Pub. No.: WO2014/128381

PCT Pub. Date: Aug. 28, 2014

(65) Prior Publication Data

US 2015/0375830 A1 Dec. 31, 2015

(30) Foreign Application Priority Data

Feb. 22, 2013 (FR) ..... 13 51584

(51) Int. Cl.
*B63B 25/16* (2006.01)
*B63B 25/14* (2006.01)
(Continued)

(52) U.S. Cl.
CPC ..... *B63B 25/16* (2013.01); *B63B 25/14* (2013.01); *F17C 3/025* (2013.01); *F17C 3/027* (2013.01);
(Continued)

(58) Field of Classification Search
CPC ..... B63B 25/16; B63B 25/14
USPC ..... 114/74 A
See application file for complete search history.

(56) References Cited

U.S. PATENT DOCUMENTS 3,339,782 A * 9/1967 Segura ..... F17C 13/082 114/74 A
3,339,783 A * 9/1967 Gorman ..... F17C 3/06 220/560.11
(Continued)

FOREIGN PATENT DOCUMENTS

FR 1379651 A 6/1963
FR 1376525 A 10/1964
(Continued)

OTHER PUBLICATIONS

International Preliminary Report on Patentability and Written Opinion, English translation issued by WIPO on Aug. 22, 2015.

*Primary Examiner* — Lars A Olson
*Assistant Examiner* — Jovon Hayes
(74) *Attorney, Agent, or Firm* — Notaro, Michalos & Zaccaria P.C.

(57) ABSTRACT

A sealed and thermally insulated tank arranged in a bearing structure (1) to contain a fluid, said tank comprising walls fixed to said bearing structure, a tank wall having a primary sealed barrier, a primary insulating barrier, a secondary sealed barrier and a secondary insulating barrier, the tank comprising a through-element arranged through the tank wall, in which tank the tank wall around the through-element comprises: secondary insulating blocks arranged on the wall of the bearing structure around the through-element and being covered by a first sealed layer forming the secondary sealed barrier, a circular plate arranged parallel to the tank wall at the same level as the first sealed layer forming the secondary sealed barrier, a second sealed layer (723*a-d*) fixed in a sealed manner straddling the first sealed layer and the circular plate all around the circular plate.

17 Claims, 8 Drawing Sheets

(51) Int. Cl.

| | |
|---|---|
| ***F17C 3/02*** | (2006.01) |
| ***F17C 13/12*** | (2006.01) |
| ***F17C 3/04*** | (2006.01) |
| ***F17C 13/00*** | (2006.01) |

(52) U.S. Cl.

CPC ..... *F17C 3/04* (2013.01); *F17C 13/004* (2013.01); *F17C 13/126* (2013.01); *F17C 2201/0104* (2013.01); *F17C 2201/0157* (2013.01); *F17C 2201/052* (2013.01); *F17C 2203/03* (2013.01); *F17C 2203/0333* (2013.01); *F17C 2203/0358* (2013.01); *F17C 2203/0631* (2013.01); *F17C 2203/0682* (2013.01); *F17C 2205/018* (2013.01); *F17C 2205/0355* (2013.01); *F17C 2209/221* (2013.01); *F17C 2209/227* (2013.01); *F17C 2221/033* (2013.01); *F17C 2223/0161* (2013.01); *F17C 2223/033* (2013.01); *F17C 2250/043* (2013.01); *F17C 2250/0452* (2013.01); *F17C 2250/0491* (2013.01); *F17C 2260/02* (2013.01); *F17C 2260/033* (2013.01); *F17C 2260/037* (2013.01); *F17C 2260/038* (2013.01); *F17C 2270/0105* (2013.01); *F17C 2270/0107* (2013.01); *F17C 2270/0113* (2013.01); *F17C 2270/0121* (2013.01); *F17C 2270/0136* (2013.01)

(56) References Cited

U.S. PATENT DOCUMENTS

| | | | | | |
|---|---|---|---|---|---|
| 3,367,492 | A * | 2/1968 | Pratt | F17C 13/001 | 114/74 A |
| 3,931,424 | A * | 1/1976 | Helf | F17C 3/04 | 114/74 A |
| 4,116,150 | A * | 9/1978 | McCown | B63B 25/16 | 114/74 A |
| 4,127,079 | A * | 11/1978 | Ito | B63B 25/12 | 114/74 A |
| 4,128,069 | A * | 12/1978 | Kotcharian | F17C 3/04 | 114/74 A |
| 4,170,952 | A * | 10/1979 | McCown | B63B 25/16 | 114/74 A |
| 4,452,162 | A * | 6/1984 | Harbaugh | B63B 25/16 | 114/74 A |
| 6,145,690 | A * | 11/2000 | Dhellemmes | B63B 25/16 | 220/4.12 |
| 7,900,794 | B2 * | 3/2011 | Dhellemmes | B63B 25/16 | 114/74 A |
| 9,291,307 | B2 * | 3/2016 | Gazeau | B63B 3/68 | |
| 9,359,130 | B2 * | 6/2016 | Jean | B65D 88/128 | |
| 2006/0096209 | A1 * | 5/2006 | Dhellemmes | B63B 3/68 | 52/405.3 |
| 2006/0096235 | A1 * | 5/2006 | Dhellemmes | B63B 25/16 | 204/267 |
| 2013/0326861 | A1 * | 12/2013 | Gazeau | B63B 3/68 | 29/525.02 |
| 2015/0375830 | A1 * | 12/2015 | Bougault | F17C 3/027 | 114/74 A |

FOREIGN PATENT DOCUMENTS

| | | | | |
|---|---|---|---|---|
| FR | 1379651 | A * | 11/1964 | B21D 51/24 |
| FR | 2781557 | A1 | 1/2000 | |
| FR | 2861060 | A1 | 4/2005 | |
| FR | 2961580 | A1 | 12/2011 | |
| WO | 2013093261 | A1 | 6/2013 | |
| WO | WO 2013093261 | A1 * | 6/2013 | F17C 13/004 |

* cited by examiner

TANK WALL COMPRISING A THROUGH-ELEMENT

The invention relates to the field of the manufacture of sealed and thermally insulated tanks. In particular, the present invention relates to tanks intended to contain cold or hot liquids, and more particularly to tanks for storing and/or transporting liquefied gas by sea arranged in a bearing structure. The present invention relates more specifically to the construction of a wall of such a tank that is to accommodate a through-element, such as a support leg or a pipe or the like.

Sealed and thermally insulated tanks may be used in various industries for storing hot or cold products. For example, in the field of energy, liquefied natural gas (LNG) is a liquid that can be stored at atmospheric pressure at around −163° C. in on-shore storage tanks or in tanks carried in off-shore structures. Such off-shore structures are particularly barges, methane tankers for transporting the product and off-shore facilities known notably by the acronyms FPSO and FSRU for the storage, liquefaction or regasification of the product.

These tanks are made up of one or more membranes associated with insulating layers. These membranes have sufficient elasticity that they withstand loadings resulting for example from the hydrostatic pressure, the dynamic pressure in the event of the cargo moving, and/or variations in temperature. However, such a sealed barrier and the underlying thermally insulating material are relatively weak and are not necessarily able to withstand the weight of a mast like the one used for loading/offloading LNG tanks. For that reason a support leg may be provided as in FR-A-2961580. In that document, the junction between the secondary sealed membrane and the support leg is achieved by means of a plate that is square in shape.

In addition, the thermodynamic conditions in tanks when a liquid such as this is stored give rise to boiling at the surface of the liquid. This boiling produces a certain quantity of vapor which causes the internal pressure of the tanks to vary. In order to control the pressure in these tanks, the evaporation gases are collected and conveyed to an evaporation manifold where, for example, they are reliquified or burnt in the machine that propels the ship.

There are therefore various functionalities that may entail passing through the multilayer structure of the tank wall using a through-element.

According to one embodiment, the invention provides a sealed and thermally insulated tank arranged in a bearing structure to contain a fluid, said tank comprising tank walls fixed to walls of said bearing structure, a tank wall having in succession, in the thickness direction from the inside toward the outside of said tank, a primary sealed barrier, a primary thermally insulating barrier, a secondary sealed barrier and a secondary thermally insulating barrier, the tank further comprising a through-element arranged through the tank wall, in which tank the tank wall around the through-element comprises:

secondary insulating blocks arranged on the wall of the bearing structure around the through-element and the secondary insulating blocks being covered by a first sealed layer forming the secondary sealed barrier, a plate arranged parallel to the tank wall having a surface facing toward the inside of the tank at the same level as the first sealed layer forming the secondary sealed barrier, the plate being connected in a sealed manner directly or indirectly to a peripheral wall of the through-element all around the through-element, a second sealed layer fixed in a sealed manner straddling the first sealed layer and the plate all around the plate in which tank the tank wall further comprises primary insulating elements arranged on the secondary sealed barrier around the through-element, the primary insulating elements being covered by primary sealed barrier elements which are connected in a sealed manner to the peripheral wall of the through-element characterized in that the plate is a circular plate having a circular exterior shape, and in that the second sealed layer comprises a circular window having a diameter smaller than the outside diameter of the circular plate.

According to other advantageous embodiments, such a tank may have one or more of the following features.

According to one embodiment, the second sealed layer is bonded to the first sealed layer and the circular plate. According to one embodiment, the second sealed layer is welded to the first sealed layer and the circular plate.

According to one embodiment, the second sealed layer comprises an annular strip which follows the circular exterior shape of the circular plate, the circular window being delimited by an interior edge of the annular strip.

According to one embodiment, the annular strip is made up of a plurality of sealed strip portions, each sealed strip portion forming an arc of a circle, for example is made up of two or four sealed strip portions.

According to one embodiment, the sealed strip portions overlap in pairs so as to form regions of overlap each one corresponding to a marginal portion of the length of the two sealed strip portions.

According to one embodiment, the second sealed layer comprises a metal foil having an annular fold surrounding the circular window and arranged between the exterior diameter of the circular plate and the first sealed layer, the annular fold forming an expansion joint between said circular plate and said first sealed layer. According to one embodiment, the annular fold is oriented toward the secondary thermally insulating barrier, the annular fold being fitted into a peripheral chimney between the support leg and the secondary insulating blocks. According to one embodiment, the peripheral chimney is filled with a compressible insulator.

According to one embodiment, the primary sealed barrier elements extend parallel to the tank wall.

According to one embodiment, the through-element has a hollow casing of tubular overall shape, the longitudinal axis of which is substantially perpendicular to the tank wall. According to one embodiment, the peripheral wall of the through-element has a circular cross section.

According to one embodiment, the through-element is a support leg for equipment immersed in the sealed tank, the support leg extending longitudinally through the tank wall and having a first end portion bearing against the wall of the bearing structure and a second end portion projecting into the tank to support the equipment away from the layer of sheet metal, the circular plate being connected in a sealed manner to the peripheral wall of the support leg all around the support leg.

According to one embodiment, the support leg passes through the primary sealed barrier in a window, said primary sealed barrier comprising connecting pieces arranged in the window around the support leg for connecting the support leg in a sealed manner to a marginal portion of the layer of corrugated sheet metal delimiting the window, said window interrupting the directrix lines of a plurality of the parallel corrugations of said at least one series and the support leg is centered on a position situated between the directrix lines of two parallel corrugations of said plurality.

According to one embodiment, the support leg is arranged at the base of a tank offloading mast.

According to one embodiment, the through-element comprises a sealed pipe, the sealed pipe defining a passage between the interior space of the tank and a vapor manifold arranged on the outside of the tank.

The pipe may take various shapes, for example the cross section of the pipe may be rectangular, circular, elliptical or square.

According to one embodiment, the tank wall around the sealed pipe further comprises:

a blanking plate connected in a sealed manner to the periphery of the sealed pipe and extending parallel to the tank wall, the blanking plate being spaced toward the outside of the tank with respect to the secondary sealed barrier, a peripheral first connecting plate fixed in a sealed manner to the entire periphery of the blanking plate and running parallel to the sealed pipe, the first connecting plate extending in the thickness direction of the tank wall and forming a rim projecting toward the secondary sealed barrier with respect to the blanking plate, the secondary insulating blocks being arranged on the wall of the bearing structure around the peripheral first connecting plate, the circular plate comprising a second connecting plate fixed in a sealed manner to a surface of the circular plate that is oriented toward the blanking plate and projecting toward the bearing structure parallel to the sealed pipe, the second connecting plate being fixed in a sealed manner to the first connecting plate all around the first connecting plate, the two mutually-spaced plates delimiting a housing, an opening formed through the circular plate to allow gas to circulate between a primary space situated between the two sealing barriers and the housing, and a pipe opening through the blanking plate and extending toward the bearing structure to define a passage between the housing and the vapor manifold.

Such a tank may form part of an on-shore storage facility, for example for storing LNG, or may be installed in an inshore or deep-water off-shore structure, notably a methane tanker, a floating storage and regasification unit (FSRU), a floating production storage and off-loading (FPSO) unit and the like.

According to one embodiment, a ship for transporting a cold liquid product has a double hull and an aforementioned tank arranged in the double hull.

According to one embodiment, the invention also provides a method for loading or offloading a cold liquid product, in which a cold liquid product is conveyed through insulated pipelines from or to an off-shore or on-shore storage facility to or from the tank of the ship.

According to one embodiment, the invention also provides a transfer system for a cold liquid product, the system comprising an aforementioned ship, insulated pipelines arranged in such a way as to connect the tank installed in the hull of the ship to an off-shore or on-shore storage facility and a pump for driving a stream of cold liquid product through the insulated pipelines from or to the off-shore or on-shore storage facility to or from the tank of the ship.

One idea underlying the invention is that of achieving sealing between a through-element and a secondary sealed membrane using flexible sealed strips bonded to surfaces connected to the through-element while at the same time limiting the concentration of stresses whatever the origin of these stresses.

Certain aspects of the invention start out from the idea of providing a sealed and thermally insulated tank in which a passage between the inside and the outside of the tank in the form of a through-element is formed through a wall of the tank and in which the wall is connected in a sealed manner with said through-element while at the same time allowing control of fluids present in the thickness of the wall of the tank.

Certain aspects of the invention start out from the idea of creating rigid metallic penetrations passing through the insulation of a sealed tank. Certain aspects of the invention start out from the idea of creating a sealed tank using a sealed barrier comprising a secondary sealed membrane connected in a sealed manner around a sealed housing situated around said through-element and extending under the secondary sealed barrier so as to make it easier to create the stopping of the secondary sealed membrane, the through-element being for example a pipe.

Certain aspects of the invention start out from the idea of creating sealing between the through-element and the secondary sealed membrane using flexible sealed strips bonded to surfaces connected to the pipe so as to simplify fitting, facilitate repairs, use a reduced quantity of flexible strips and produce a reliable bond.

Certain aspects of the invention start out from the idea of creating a sealed space in the wall of the tank between the secondary sealed membrane and a primary sealed membrane in contact with the fluid and of creating a circuit to allow effective circulation of fluids within the sealed space and the housing.

Certain aspects of the invention start out from the idea of creating a tank that offers good resistance to thermomechanical stresses. To that end, certain aspects of the invention start out from the idea of limiting the vibrations of the pipe to which elements of said tank wall are bonded so as to protect said bonds of the elements. Certain aspects of the invention start out from the idea of fixing the pipe in such a way as to compensate for its thermal contraction with respect to the tank wall and thus limit thermomechanical stresses applied to said bonds.

Certain aspects of the invention start out from the idea of allowing equipment that is to be immersed in a tank to be supported on a leg bearing directly or indirectly against the bearing structure so as to avoid or limit load applied to a relatively fragile corrugated sealing membrane. Certain aspects of the invention start out from the idea of arranging such a support leg in such a way that it does not endanger the essential mechanical properties of the secondary sealing membrane, notably the sealing thereof and its resistance to thermal contraction or pressure forces.

The invention will be better understood and further objects, details, features and advantages thereof will become more clearly apparent during the course of the following description of a number of specific embodiments of the invention which are given solely by way of nonlimiting illustration with reference to the attached drawings.

A sealed and thermally insulating tank is made up of tank walls fixed to the interior surface of corresponding walls of a bearing structure. The bearing structure is, for example, the interior hull of a double-hulled ship or a construction situated on land. In order to contain a cold liquid such as LNG, the walls of the tank comprise at least one sealing barrier and at least one thermal insulation barrier. As a safety precaution, it is possible to provide a secondary sealing barrier between the bearing structure and the sealing barrier, which in such cases is then referred to as the primary sealing barrier.

The tank may be produced to various geometries, for example prismatic geometry in the hull of a ship or cylindrical geometry on land, or the like. By convention, "on top of" will refer to a position situated closer to the inside of the tank and "under" will refer to a position situated closer to the bearing structure 1, regardless of the orientation of the tank wall with respect to the earth's gravitational field.

Figure 1:
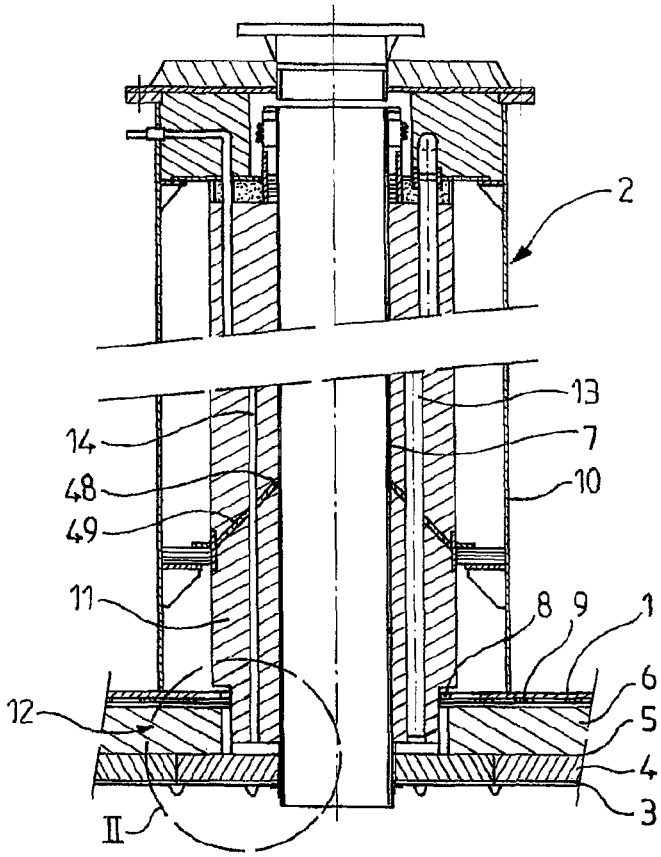
FIG. 1 is a view in cross section of a tank wall comprising a fluid collection device.

FIG. 1 shows a fluid collection device 2 passing through a roof of a tank.

Such a tank wall has, in succession from the inside of the tank toward the bearing structure 1, a primary sealing barrier 3 in contact with the product contained in the tank, a primary thermally insulating barrier 4, a secondary sealing barrier 5 and a secondary thermally insulating barrier 6. The primary thermally insulating barrier, the secondary sealing barrier and the secondary thermally insulating barrier essentially consist of a collection of prefabricated panels resting on beads of mastic 9 and fixed to the bearing structure 1, in this instance the roof.

The bearing structure 1 comprises a circular opening 8 around which is welded a barrel 10 which extends to the outside of the bearing structure 1. A vapor collecting metal pipe 7 is anchored inside the barrel 10 and intended to extract the vapors produced by evaporation of fluid in the tank. For that purpose, the collecting pipe 7 passes through the tank wall at the center of the circular opening 8, and the sealed barriers 3 and 5 and the insulating barriers 4 and 6 to open to the inside of the tank. This collecting pipe 7 is notably connected to a vapor manifold outside the tank which extracts this vapor and for example transfers it to the ship propulsion device in order to power the propulsion of the ship or to a liquefaction device for then reintroducing the fluid into the tank.

The sealing barrier 3 is connected in a sealed manner to the collecting pipe 7. Likewise, the sealing barrier 5 is connected in a sealed manner to the collecting pipe 7 except in a passage allowing the fluid present between the two sealing barriers to circulate to the secondary pipes 13 and 14. In this way, the space between the secondary sealed barrier 5 and the primary sealed barrier 3 forms a primary sealed space connected to the two secondary pipes 13 and 14.

Moreover, the barrel 10 is connected in a sealed manned to the bearing structure 1 and to the collecting pipe 7. The collecting pipe comprises an insulating layer 11 distributed uniformly over the external extent thereof which has a diameter smaller than the circular opening 8. In this way, the spacing between the insulating layer 11 and the circular opening 8 allows fluid to circulate between the secondary insulating barrier and an intermediate space present between the barrel 10 and the insulating layer 7. The intermediate space and the space between the bearing structure and the secondary insulating barrier 6 thus form a secondary sealed space.

The two secondary pipes 13 and 14 extend parallel to the collecting pipe 7 in the insulating layer 11 of the collecting pipe 7 from the outside of the barrel 10 as far as the primary sealed space. The first pipe 13 makes it possible to create a passage between the primary sealed space and a discharge member, not depicted, that allows fluids present in the primary space to be controlled. The second pipe 14 creates a passage between the primary space and a pressure measurement member, not depicted. These two secondary pipes 13 and 14 notably allow the primary sealed space to be swept with nitrogen.

Two other pipes, not depicted, are welded to the barrel 10 and open to the inside of the barrel 10 into the secondary sealed space so that they to allow control of fluids and measurement of pressure in the secondary sealed space. The pipes connected to the secondary sealed space also allow the secondary sealed space to be swept with nitrogen.

A region II of the tank wall through which the collecting pipe 7 passes will now be described in greater detail with reference to FIG. 2.

A prefabricated panel 12 positioned near the collecting pipe 7 comprises a rigid lower panel 15 supported by beads of mastic 9. The lower panel 15 bears a layer of polyurethane foam thermal insulation 16 and therewith constitutes a secondary thermally insulating barrier element 6. A layer 17 of flexible or rigid composite material referred to as Triplex® adheres substantially to the entire surface of the layer of thermal insulation 16 of the secondary thermally insulating barrier element 6, said layer 17 forming a secondary sealing barrier element 5. A second layer of polyurethane foam thermal insulation 18 partially covers the layer 17 and adheres thereto. A rigid top panel 19 covers the second layer of thermal insulation 18 and therewith constitutes a primary thermally insulating barrier element 4.

As explained hereinabove with reference to FIG. 1, the collecting pipe 7 passes through the circular opening 8, the sealed barriers 3 and 5 and the insulating barriers 4 and 6. Sealing between the secondary insulating barrier and the collecting pipe 7 is achieved by way of a first plate 20 extending around the pipe and blanking off a tube 21. The tube 21 is surmounted in a sealed manner by a second plate 22 the exterior shape of which is square. In this way, the two plates 20 and 22 form a housing. Flexible strips 23 are bonded between the layer 17 and the second plate 22 in order to stop the secondary sealed barrier 5 in a sealed manner.

The circular first metal plate 20 is welded around the collecting pipe 7 between the bearing structure 1 and the secondary sealed barrier 5. The circular first plate 20 is welded on its entire periphery to the interior bearing surface of the metal tube 21. The metal tube has a diameter smaller than the opening 8 of the bearing structure 1 and extends above the circular first plate 20 as far as a region near the level of the secondary sealed barrier 5.

The second plate 22 is welded to the upper end of the tube 21. The second plate 22 comprises a circular passage 25 through which the pipe 7 passes. This circular passage 25 has a diameter greater than the diameter of the collecting pipe 7 so as to leave a space between the second plate 22 and the collecting pipe 7. By virtue of this spacing, the fluid can circulate from the primary space situated between the sealed barriers 3 and 5, toward the housing 24.

A tubular part 26 is welded to the lower surface of the second plate 22 and is centered on the passage 25 of the second plate 22. The inner bearing surface of the tubular part 26 has a diameter substantially equal to the external diameter of the tube 18. In this way, the tube 21 and the tubular part 26 of the second plate 22 can fit into and collaborate in sliding with each other when not welded together. Thus, during the welding of the tubular part 26 to the tube 21, the separation between the second plate 22 and the bearing structure 1 can be adjusted so as to place the second plate 22 substantially at the level of the secondary sealing barrier 5. Moreover, fitting the tube 21 and the tubular part 26 together allows the centering of the opening 25 with respect to the pipe and the orientation of the second plate 22. The welds between the first plate 20, the tube 21 and the second plate 22 are made around their entire periphery so as to obtain sealing between these elements.

The tube 21 furthermore extends under the circular first plate 20 as far as a region beyond the bearing structure 1. A metal ring 27 has an interior contour to which the end of the tube 21 situated in the region beyond the bearing structure is welded. The ring 27 has a surface parallel to the wall of the tank on which the insulating layer 11 of the collecting pipe 7 is bonded. The circular first plate 20 furthermore comprises two orifices 28 to which the two secondary pipes 13 and 14 (not depicted in FIG. 2) are welded.

The first plate 20, the second plate 22 and the tube 21 and the tubular part 26 are made of stainless steel.

A tile 29 is positioned so that it straddles the prefabricated panel 12 and the second plate 22 in order to form part of the insulating barrier between the collecting pipe 7 and the prefabricated panel 12. This tile 29, like the prefabricated panel 12, has an insulating layer 31 pressing against the secondary sealed barrier 5. This insulating layer 31 is surmounted by a top panel 30.

The top panels of the prefabricated panel 12 and of the tile 29 support the primary sealing barrier 3 in the form of fine sheet metal plates with corrugations 32. These corrugations 32 form elastic zones for absorbing the thermal contraction and the static and dynamic pressure loadings. Such sealing barriers made of corrugated sheet or checker plate have notably been described in FR-A-1379651, FR-A-1376525, FR-A-2781557 and FR-A-2861060. The primary sealed barrier 3 is connected in a sealed manner to the collecting pipe 7 via a flange 33 the cross section of which forms an L. This flange 33 is welded to the thin sheet metal and to the collecting pipe 7.

Figure 2:
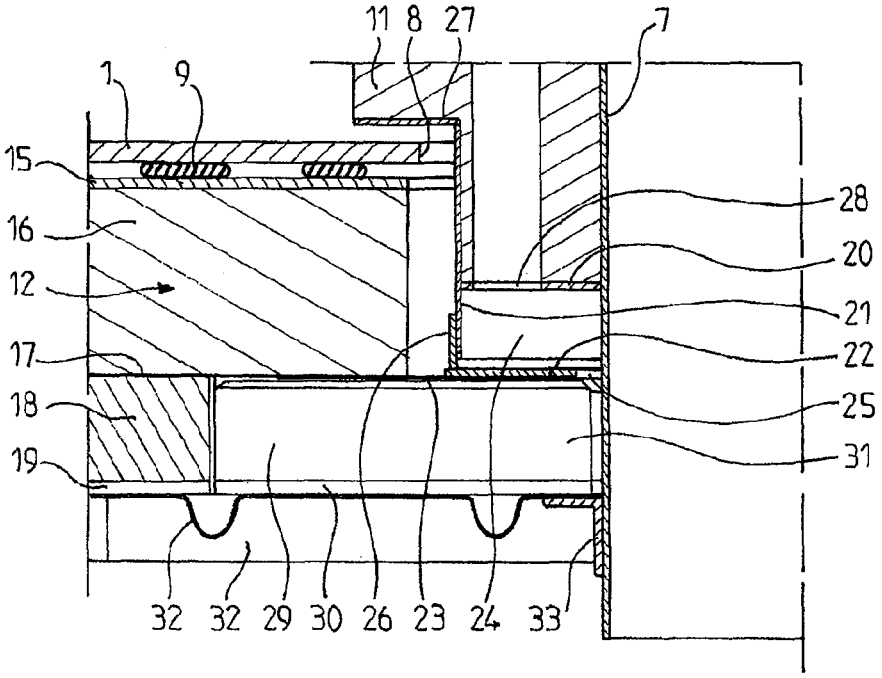
FIG. 2 is an enlarged view in cross section of region II of FIG. 1 according to an embodiment useful in understanding the invention.
Figure 3:
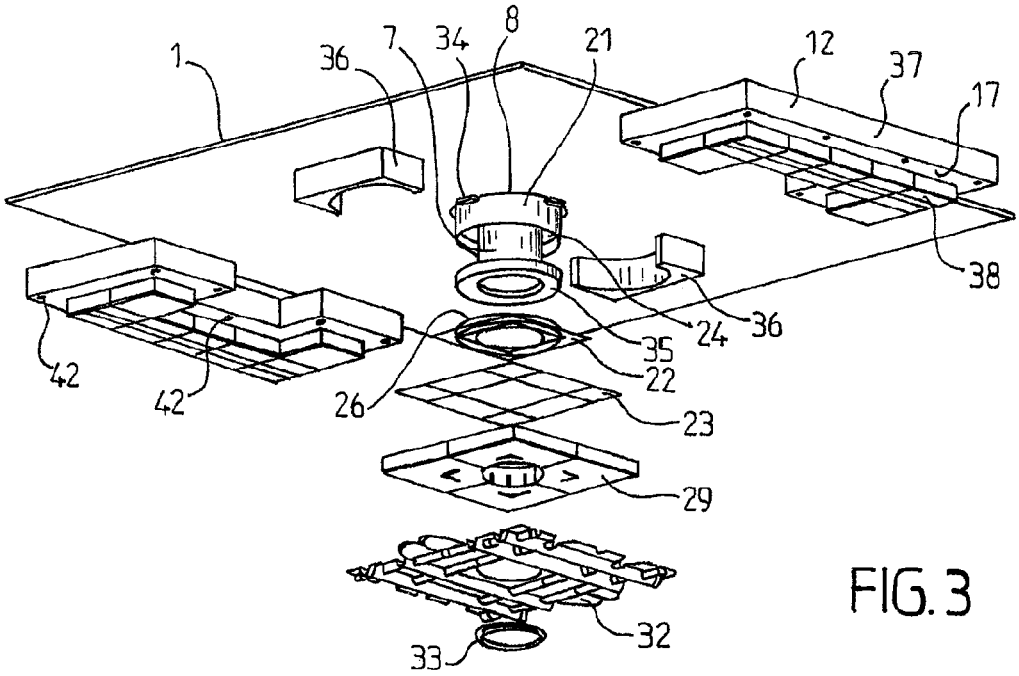
FIG. 3 is a partial exploded perspective view of the tank wall shown in FIG. 2.

With reference to FIG. 3 it is possible to see in greater detail the structure of the elements shown in FIG. 2: the collecting pipe 7 and the tube 21 pass through the bearing structure 1 at the center of the opening 8. The tube 21 is centered in the opening 8 via four centering blocks 34 distributed pressing in a balanced manner around the tube 21. The centering blocks 34 are screwed to the bearing structure 1 and are made of high density polyethylene. The blocks 34 make it possible to prevent vibrations of the tube 21 and of the collecting pipe 7 and thus allow the degradation of the bonding of the secondary barrier 5 to be avoided.

A glass wool packing 35 is introduced into the housing 24. The second plate 22 is positioned on the tube 21 so that the second plate 22 is substantially at the same level as the secondary sealed barrier. The tubular part 26 of the second plate is welded to the tube 21. To avoid a risk of burning the glass wool packing 35, a heat shield, not depicted, is positioned beforehand between the packing 34 and the tube 21 and the tubular part 26. This packing is porous to allow fluid to circulate freely in the housing between the primary sealed space and the secondary pipes 13 and 14.

Placed around the tube 21 are two parts 36 of glass wool wadding which together exhibit a square exterior contour of a dimension greater than the second plate 22. Each of the two parts 36 comprises an interior contour in the shape of a semicircle so that it can press against the exterior bearing surface of the tube 21 and the tubular part 26.

The secondary insulating barrier 6, the secondary sealing barrier 5 and the primary insulating barrier 4 are created using two prefabricated panels 12. Each of the panels 12 around the collecting pipe 7 is in the overall shape of U-shaped steps with a lower U-shaped insulating block 37 constituting one element of the secondary insulating barrier, a sealed layer 17 completely covering the shaped upper surface of the block, and a U-shaped upper insulating block 38 of smaller size constituting one element of the primary insulating barrier 4 so as to leave a region of the sealed covering 32 situated over the entire rim of the lower block 37 uncovered. The panel can be prefabricated by bonding together polyurethane foam and plywood for the insulating barriers. Thus, the lower block 37 comprises the lower panel 15 and the layer of insulating foam 16 and the upper block comprises the insulating layer 18 and the upper panel 19. The two U-shaped prefabricated panels are juxtaposed to surround the two parts 37 of the wad of glass wool. Each prefabricated panel 12 further comprises chimneys 42 which, at the time of fitting, provide access to the fixings of the prefabricated panel 12 that allow the prefabricated panel 12 to be anchored on studs (not depicted) welded to the bearing structure 1 beforehand.

Figure 4:
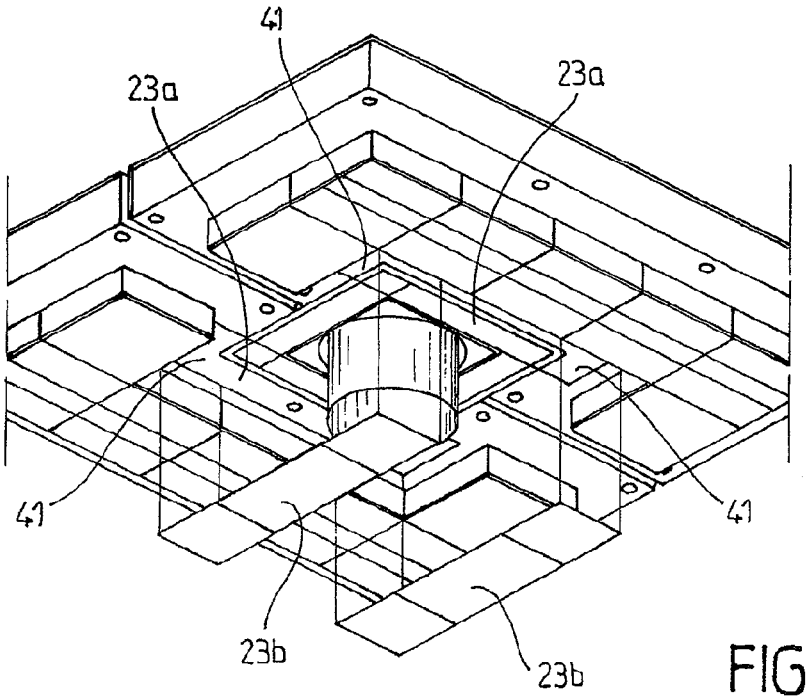
FIG. 4 is a partial perspective view of the tank wall of FIG. 2 comprising a secondary sealed membrane which is stopped around the fluid collection device.

Four flexible strips 23 are bonded each straddling one side of the second plate 22 and the sealed layer 17 of the uncovered region of the U-shaped prefabricated panel 12. The second plate 22 is square in shape allowing for linear flexible strips. The flexible strips are bonded using a polyurethane adhesive. FIG. 4 shows in greater detail how the flexible strips 23 are bonded. Two first flexible strips **23*a* are bonded straddling the interior part of the U-shaped prefabricated panels 12 then the two flexible strips 23*b* are bonded straddling the two prefabricated panels 12 and the second plate 22 while at the same time being bonded to the end 41 of the two first flexible strips 23*a* in order to straddle them. This method of bonding is therefore reliable, easy to achieve during fitting, and simplifies any repairs required because the bonding zone is very narrow, making unsticking easier. Furthermore, this bonding to stop the secondary membrane 5** can be performed automatically.

Returning now to FIG. 3, it may be seen that four tiles 29 are positioned on the flexible strips to complete the primary sealed barrier. The tiles 29 have one side shaped as an arc of a circle to accommodate the collecting pipe 7. The arc of a circle has a diameter greater than the diameter of the collecting pipe as can be seen in FIG. 2. That makes it possible to leave a space for a glass wool packing, not depicted, between the pipe 7 and the tiles 29.

The thin metal sheets of the sealed barrier are then fixed to the primary insulating barrier. These are positioned in such a way that the region of the primary sealed barrier through which the collecting pipe passes does not have a corrugation 32 passing through it. In this way, the region through which the collecting pipes 7 passes is substantially planar and allows the flange 33 to be fitted and welded.

Figure 5:
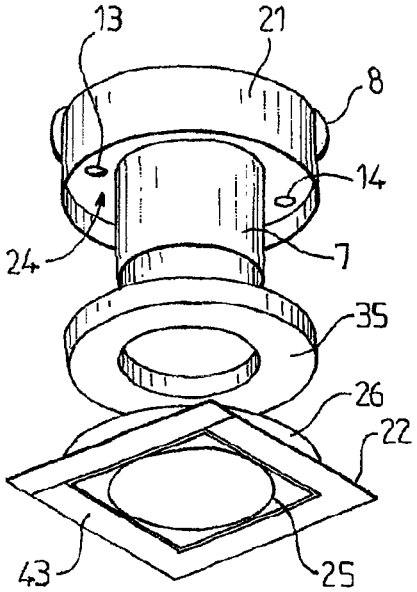
FIG. 5 is an exploded perspective view of the fluid collection device passing through the wall of the tank.

FIG. 5 more specifically shows the second plate 22 of FIG. 3. Strips of rigid layer 43 are bonded between the sides of the square part of the second plate 22 and the circular passage 25. The strips of flexible sealed layer 23 are bonded to these rigid layers. In this way, the strips of flexible layer 23 are bonded only to rigid sealed layers.

Figure 6:
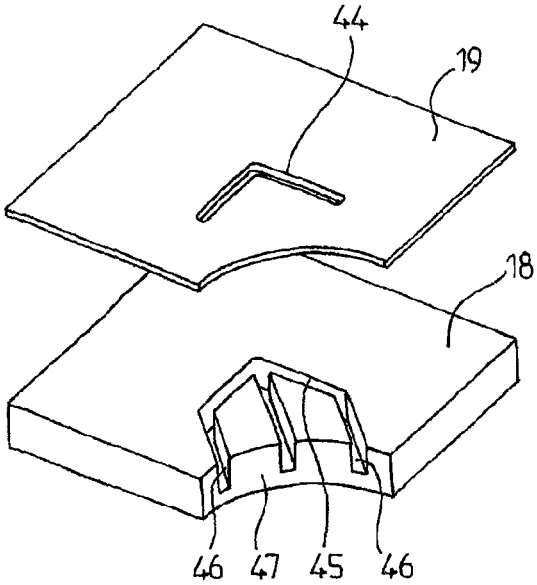
FIG. 6 is an exploded perspective view of a primary insulating tile of FIG. 2 intended to be positioned near to the fluid collection device.

FIG. 6 reveals the structure of the tiles 29 that allow fluid to circulate between the corrugations 32 and the housing 24. The upper panel has a slot 44 forming a right angle passing through the panel between the upper surface and the lower surface thereof. When the primary sealed barrier is being fitted, two mutually perpendicular corrugations 32 are superposed on the slot 44 so as to allow fluid present in the corrugations to circulate toward the insulating layer 18. This insulating layer further comprises a connecting slot 45 corresponding to the slot 44 of the upper panel and from which three parallel slots 46 extend toward the circular-arc-shaped part of the tile onto which they open. The slots 45 and 46 of the insulating layer 18 of the tile 29 are filled with glass wool of a density of 22 kg/m$^3$. Thus, gaseous fluid that has passed through the upper panel can circulate to outside the tile, in the space between the tile and the connecting pipe 7.

This specific structure of the tiles 29, the spacing between the circular passage 25 and the collecting pipe and the housing 24 comprising a porous packing 35 makes it possible to create a circuit for the fluids to make it easier for them to circulate in the primary sealed space, notably from the corrugations 32 as far as the secondary pipes 13 and 14 and vice versa.

Likewise, the space between the circular opening 8 and the pipe 21 and between the bearing structure 1 and the lower panels 15 makes it possible to generate a circuit for the fluid between the secondary space and the barrel 10. These circuits notably allow the wall of the tank to be inerted using nitrogen.

In order to reduce the stresses applied to the bonds made around the collecting pipe, the pipe 7 is anchored at a part 48 of the pipe 7 that is spaced away in the opposite direction inside the tank with respect to the bearing structure 1. In this way, the contraction of the collecting pipe 7 when subjected to low temperatures is equivalent to the contraction of the secondary insulating barrier 5 at the region bonded to the second plate 22. Thus, the stresses on the bonds of the tank wall are reduced. This anchorage comprises a metal frustoconical element 49 welded to the sealed pipe 7. The frustoconical element 49 presses against a support extending up inside the barrel 10.

Figure 7:
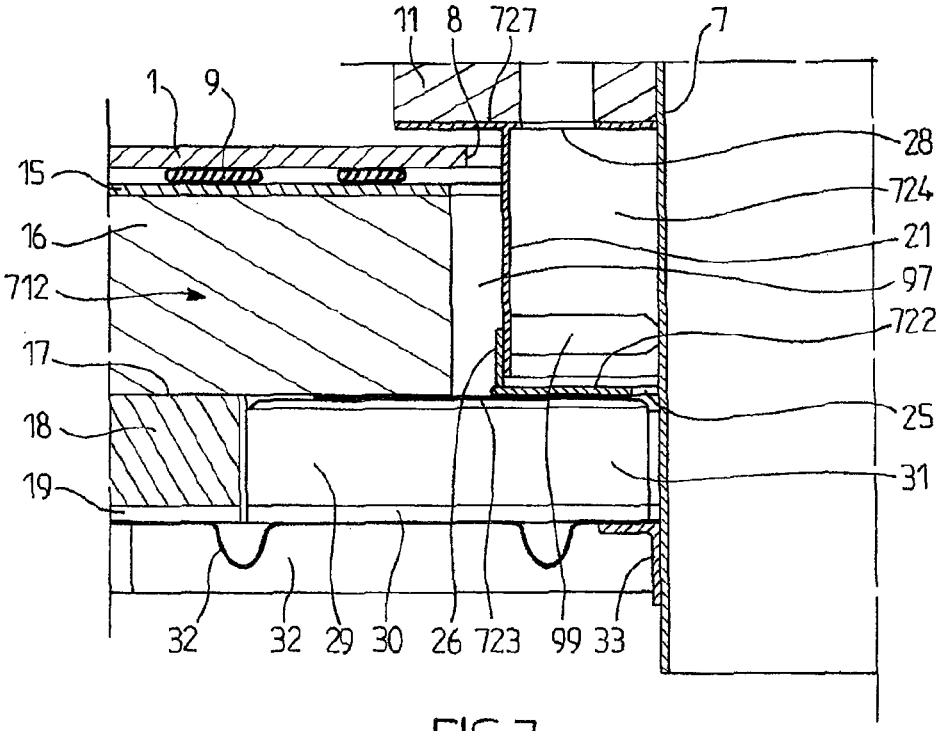
FIG. 7 is an enlarged view in cross section of region II of FIG. 1 according to one embodiment of the invention.
Figure 8:
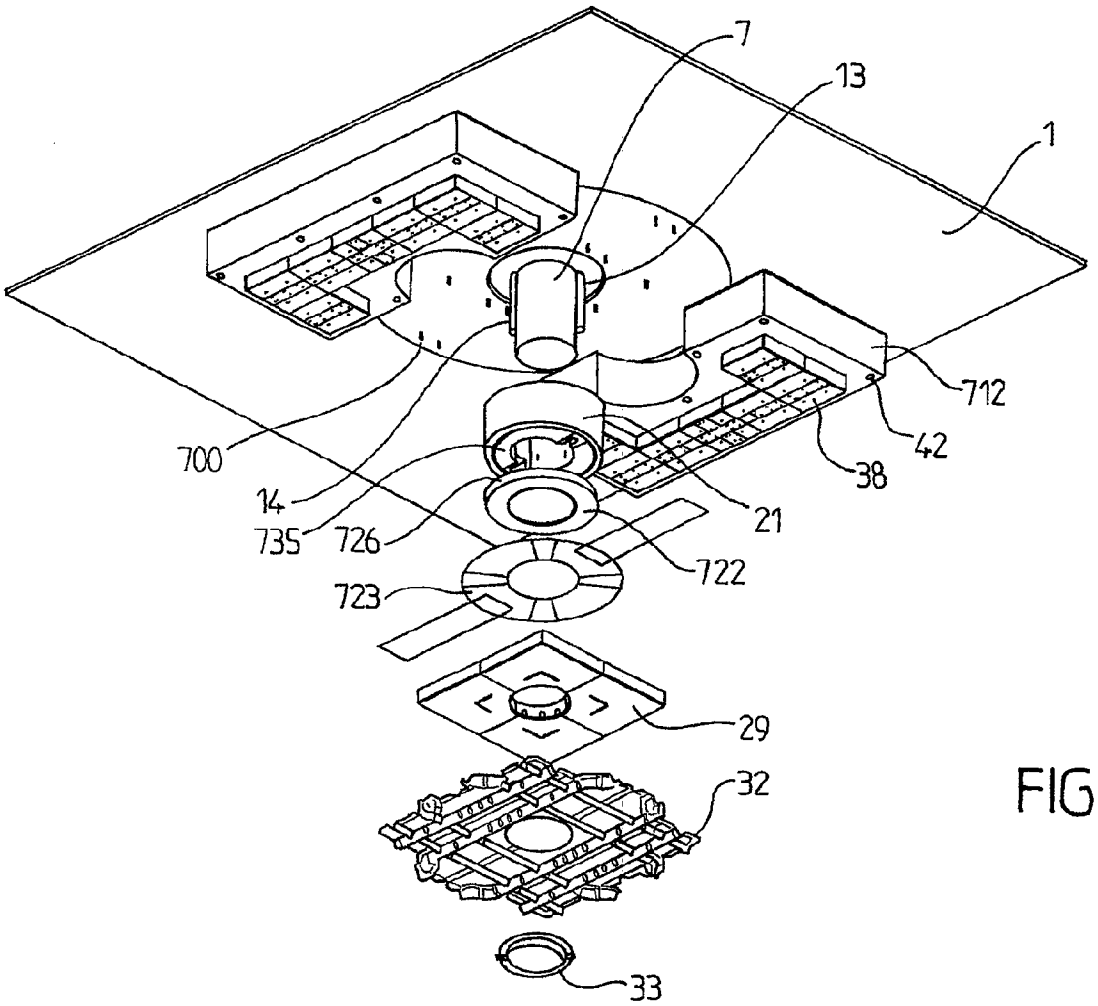
FIG. 8 is a partial exploded perspective view of the tank wall shown in FIG. 7.
Figure 9:
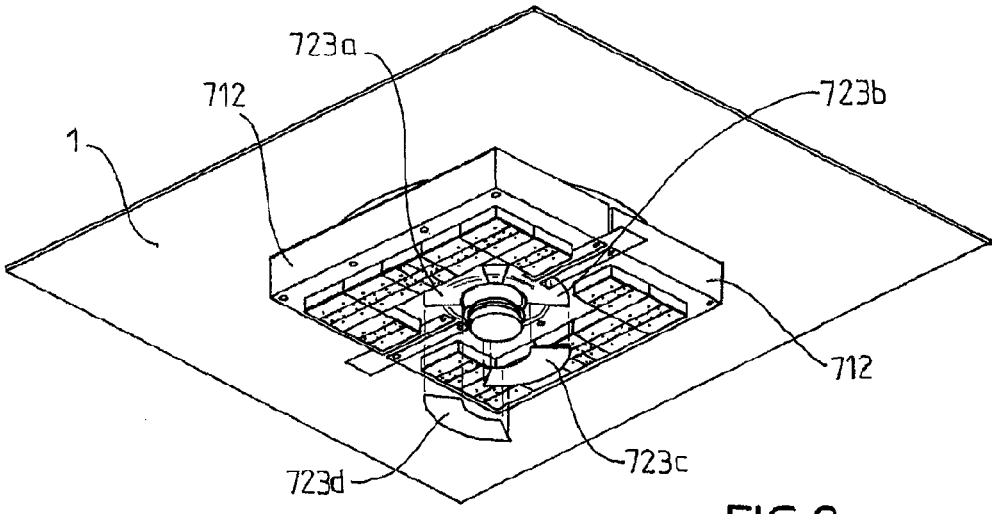
FIG. 9 is a partial perspective view of the tank wall of FIG. 7 comprising a secondary sealed membrane which is stopped around the fluid collection device.

One embodiment of the roof wall fitted with a vapor manifold will now be described with reference to FIGS. 7 to 9. This embodiment makes it possible to reduce the stresses borne by the flexible strips 23 with respect to the embodiment of FIGS. 2 to 6 described hereinabove. In FIGS. 7 to 9 elements identical to those of FIGS. 2 to 6 bear the same reference numeral. Elements which are similar but modified bear the same reference numeral increased by 700.

As explained hereinabove with reference to FIG. 2, the collecting pipe 7 passes through the circular opening 8, the sealed barriers 3 and 5 and the insulating barriers 4 and 6. Sealing between the secondary insulating barrier and the collecting pipe 7 is achieved by means of a blanking plate 727 extending around the collecting pipe 7. This blanking plate, positioned at the top of the tube 21, blanks it off at this end. At the other end of the tube 21, the tube is connected by a tubular part 26 to a circular plate 722 the exterior periphery of which is circular. The entity consisting of the tube 21 and the two plates 727 & 722 forms a housing 724. The design of this housing renders it sealed with respect to the secondary barrier and the inside of the tank. This housing forms part of the primary space to which it is connected by the circular passage 25. To allow vapor present in this housing to be removed, the two secondary pipes 13 and 14 (depicted in FIG. 8) are connected in a sealed manner to the blanking plate 727. The device thus formed does not allow any vapor that might be present in the primary space to escape to anywhere other than via these two pipes 13 and 14. This design also allows sweeping with an inert gas. To guarantee insulation, the housing 724 is filled with an insulator that is permeable to vapor and gas.

According to an alternative form, between the tube 21 and the prefabricated panel 712, a gap 97 is also filled with mineral wool in order to ensure the continuity of the insulation.

Furthermore, in this alternative form, fins 99 are arranged evenly between the inside of the base of the tube 21 and the periphery of the collecting pipe 7 in order to position and secure the tube 21 with respect to the collecting pipe 7.

FIG. 8 shows an exploded perspective view of the structure at the insulating and sealing barriers of the elements shown in FIG. 7.

The secondary insulating barrier 6, the secondary sealing barrier 5 and the primary insulating barrier 4 are produced using two prefabricated panels 712 that differ from those of FIG. 3. The two U-shaped prefabricated panels 712 are juxtaposed to surround the tube 21. Each prefabricated panel 712 has an interior contour in the shape of a semicircle so as to press against the exterior bearing surface of the tube 21 and the tubular part 26, thus potentially making the glass wool wadding 36 of the embodiment of FIG. 3 redundant.

Each of the panels 712 around the collecting pipe 7 has the overall shape of U-shaped steps with a U-shaped lower insulating block 37 constituting one element of the secondary insulating barrier, a sealed layer 17 completely covering the shaped upper surface of the block, and a U-shaped upper insulating block 38 of a smaller size constituting one element of the primary insulation barrier 4 so as to leave a region of the sealed covering 32 situated all around the rim of the lower block 37 uncovered. The panel can be prefabricated by bonding together polyurethane foam and plywood for the insulation barriers. Thus, the lower block 37 comprises the lower panel 15 and the layer of insulating foam 16 and the upper block comprises the insulating layer 18 and the upper panel 19. Each prefabricated panel 712 further comprises chimneys 42 providing access, at the time of fitting, to the fixings of the prefabricated panel 712 that allow the prefabricated panel 712 to be anchored on studs 700 welded to the bearing structure 1 beforehand.

Inside the tube 21, in the housing 724, a mineral wool packing 735 is introduced in order to provide insulation, this for example being glass wool. As an alternative, this packing is polyurethane foam.

To ensure the continuity of the sealing of the sealed layer, a flexible annular strip 723 is used. Four flexible strip portions 723 are bonded each straddling a circle portion of the circular plate 722 and the sealed layer 17 of the uncovered region of the prefabricated panel 712.

Another feature that is visible in FIG. 8 is the presence of an added disk 700 which forms the roof wall around the pipe 7. The disk 700 is made of an alloy that is better able to withstand the cold than the rest of the bearing wall given that this region is likely to be exposed to colder temperatures.

FIG. 9 shows in greater detail how the flexible strip portions 723 are bonded. The first strip portion 723*a* is bonded straddling the interior part of the prefabricated panels 712 and on a circular arc of the circular plate 722. The second strip portion 723*b* is bonded straddling the end of the first strip portion 723*a*, to cover a marginal part of this first strip portion 723*a* on the one hand, and straddling the two prefabricated panels 712 and the circular plate 722. The third strip portion 723*c* is positioned using the same method, overlapping the strip portion 723*b*. Finally, the last strip portion 723*d* is placed to finalize the sealing in the region of the circular plate 722. Just as with the strips 723*a* to 723*c*, the strip portion 723*d* is bonded straddling the circular plate 722 and the prefabricated panels 712, but also covers the end regions of the adjacent strip portions 723*a* and 723*c*. Thus, the continuity of the sealing is ensured by a proximity overlap of adjacent strip portions.

As an alternative, the strip portions are bonded edge to edge and another strip portion is bonded over the join in order to achieve sealing.

The use of a circular plate 722 and of an annular strip makes it possible to reduce the stresses borne by the flexible strip 723 notably by eliminating corner regions liable to concentrate the stresses. Table 1 illustrates, by way of example, the savings obtained in the case of a methane tanker. Studies conducted into the two types of membrane show a systematic reduction in the stresses experienced by the flexible strip when using a circular plate as compared with a square plate. For example, in the case of a secondary insulating barrier of great thickness, tests have shown that the stresses absorbed by a square plate, as described in FIGS. 2 to 6, are at least 23% higher than those experienced by a circular plate, all other things being equal.

TABLE 1 measurement of stress on the flexible strips for a primary insulating barrier 100 mm thick.

| Secondary insulating barrier | Plate geometry | Improvement (in %) |
|---|---|---|
| Standard thickness 170 mm | Square<br>Circular | 13.5 |
| Great thickness 300 mm | Square<br>Circular | 23 |

Figure 13:
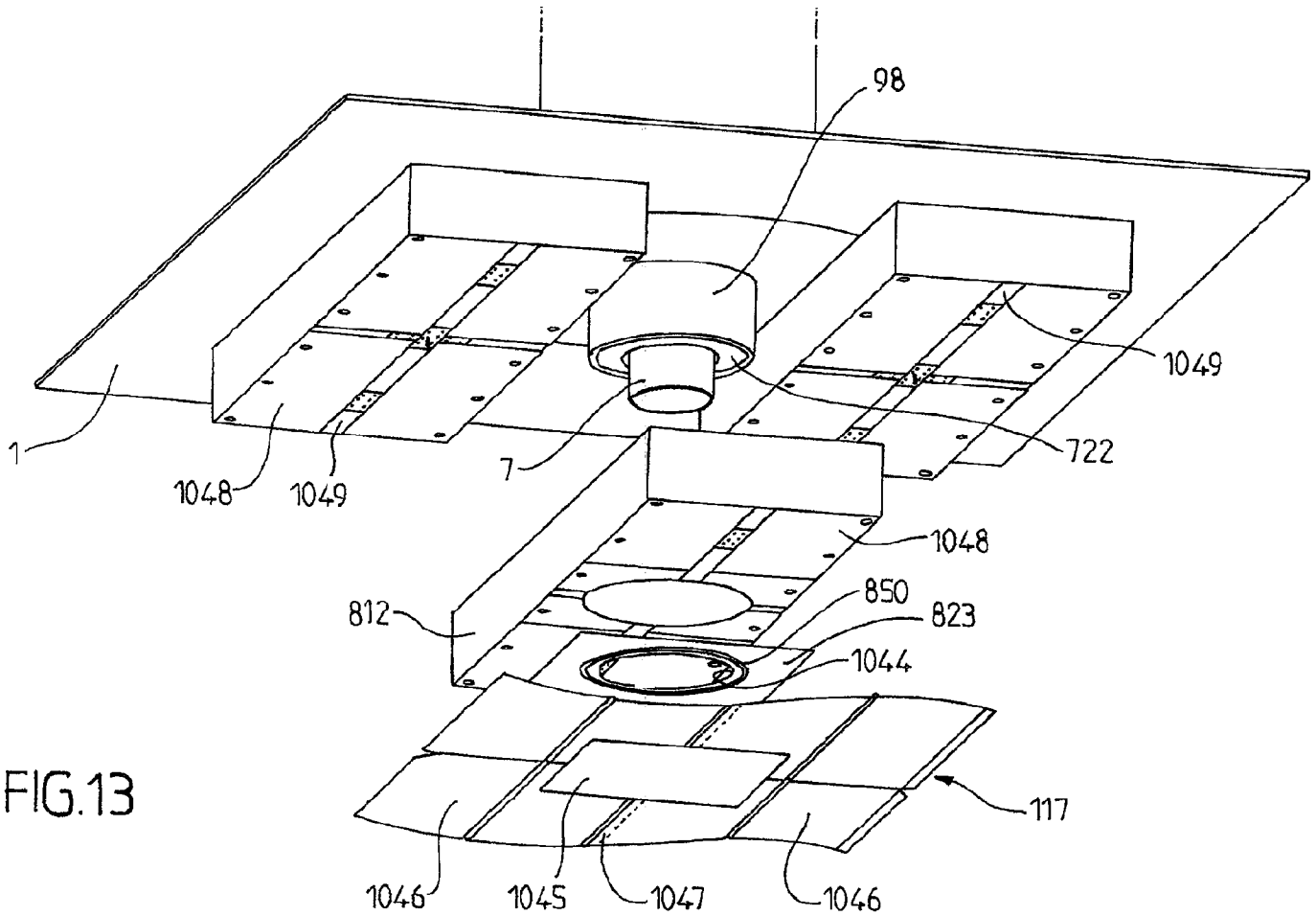
FIG. 13 is an exploded perspective view of another embodiment of the invention.

Another embodiment as an alternative to the embodiment of FIGS. 7 to 9 will now be described with reference to FIG. 13. In FIG. 13, elements identical to those of FIGS. 7 to 9 bear the same reference numerals. Elements that are similar but modified bear the same reference numerals increased by 100.

As in the previous embodiment, a collecting pipe 7 passes through the bearing structure 1, the sealed barriers and the insulating barriers. Around the collecting pipe 7, the secondary insulating barrier is created using a prefabricated panel 812 comprising a cylindrical opening. This opening allows the elements surrounding the collecting pipe 7 described in FIG. 7 and reiterated in this embodiment to pass through. FIG. 13 shows only the mineral wool 98 and the circular plate 722. After the prefabricated panel 812 has been fitted, the circular plate 722 lies flush with the surface of the prefabricated panel 812.

The secondary sealing barrier is obtained using a sealed membrane 117 which covers the entire secondary insulating barrier except for an opening 1045 in the region of the collecting pipe 7. The sealed membrane 117 is held on the prefabricated panels 812. For that, the cover 1048 comprises metal inserts 1049. The membrane 117 is for example made up of strips 1046 of sheet metal the adjacent edges of which are lap welded 1047 to the inserts 1049. The membrane 117 is made of sheet metal made from a nickel steel alloy with a very low coefficient of expansion.

The continuity of the sealing with the circular plate 722 is ensured using a connecting layer 823. This layer 823 partially covers the circular plate 722 to which it is fixed in a sealed manner. Likewise, it is partially covered by the sealed membrane 117 to which it is likewise fixed in a sealed manner. This attachment is, for example, an attachment using sealed welding. The layer 823 is made of metal, for example the same alloy as the membrane 117.

The layer 823 comprises a circular hole 1044 for the passage of the pipe 7. It further comprises a circular wave 850 forming an elastic region. This wave absorbs static and dynamic pressure loadings. It also is able to absorb the thermal contraction by opening to a greater or lesser extent.

The exterior periphery of the layer 823 is rectangular in shape, so as to make it easier to connect to the sealed membrane 117. In an alternative form, the exterior shape of the layer 823 is circular.

Although in the embodiments described hereinabove the collecting pipe passes through a roof of the tank, in another embodiment the pipe could pass through the wall of the tank at the top of a side wall of the tank.

A tank wall through which a pipe passes and structures for reestablishing the sealing of the sealed barriers around this pipe have been described hereinabove. Similar structures can be used around other through-elements arranged on a tank wall.

A support leg immersed in a sealed tank will now be described with reference to FIGS. 10 and 11. In the bottom, the tank comprises an elongate rigid element constituting a support leg 910 which extends through the thermal insulation barrier and the sealing barrier so that one end bears against the bottom wall 100 of the bearing structure and the other end projects into the tank some distance from the sealing barrier. The support leg 910 may for example be used to support equipment that has to be immersed in the tank. For example for supporting an offloading pump, it may be arranged at the base of a tank pumping mast, not depicted. Although the support leg is depicted here on a bottom wall of the tank, a similar rigid element may be arranged in the same way at other points in the tank, for example as support or spacer element for keeping some arbitrary object some distance away from the tank wall.

In order to create the primary sealing barrier it is possible to use thin sheet metal plates with corrugations that form elastic regions for absorbing the thermal contraction and static and dynamic pressure loadings. Such sealing barriers made of corrugated sheet metal or checker plate have notably been described in FR-A-1379651, FR-A-1376525, FR-A-2781557 and FR-A-2861060.

Figure 10:
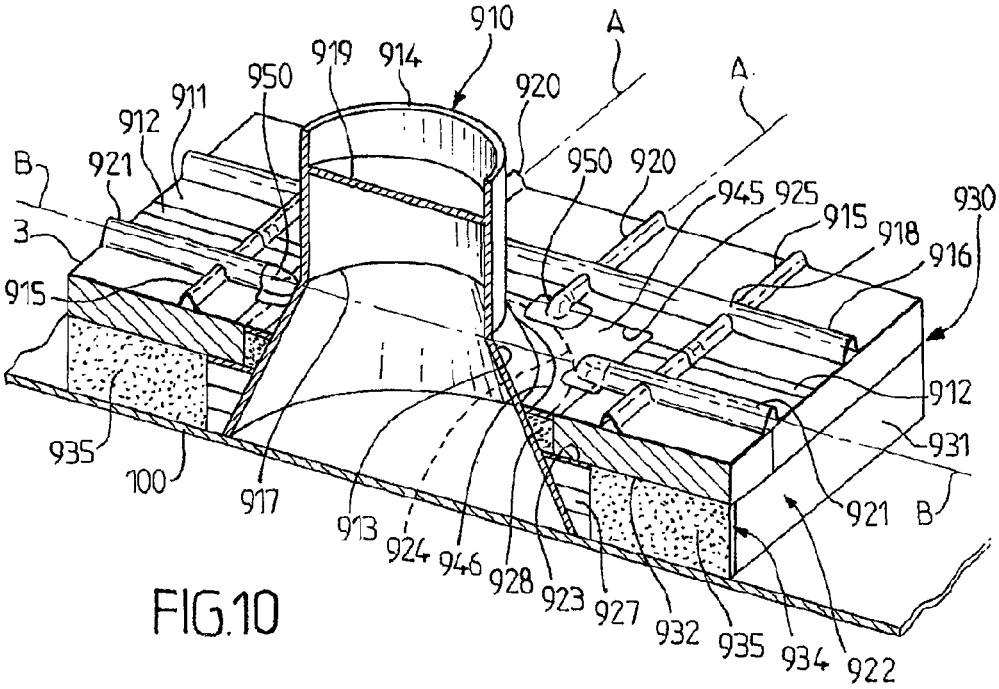
FIG. 10 is a perspective depiction, in cross section, of a tank wall structure and of a support leg that can be used in a tank.

In FIG. 10, the support leg 910 here has a shape exhibiting symmetry of revolution with a circular cross section, with a frustoconical lower part 913 connecting at its smaller-diameter end 917 to a cylindrical upper part 914. The larger-diameter base of the frustoconical part 913 bears against the wall of the bearing structure. The frustoconical part 913 extends through the thickness of the tank wall beyond the level of the sealing barrier 3. The cylindrical part 914 is closed in a sealed manner by a circular plate 919 which may for example be welded to an interior rim, not depicted, of the cylindrical part 914.

In order to allow the support leg 910 to pass through, the corrugated sealed plates 911 forming the sealing barrier 3 are cut to delimit a square window 925 around the support leg 910. In order to ensure the continuity of the sealing barrier 3 at the window 925, a sealed assembly of connecting pieces is achieved between the support leg 910 and the sealed plates 911. Because the diameter of the support leg 910 is greater than the spacing between the corrugations of the first series 915, some of the longitudinal corrugations, indicated by the numeral 920 and the directrix line A of which intersects the support leg 910, have been interrupted at the window 925. Likewise, because the diameter of the support leg 910 is greater than the spacing between the corrugations of the second series 916, some of the transverse corrugations indicated by the numeral 921 and the directrix line B of which intersects the support leg 910 have been interrupted at the window surrounding the support leg.

Moreover, as can be seen in FIG. 10, the size of the window 925 is, in practice, greater than the diameter of the support leg 910 so that it is relatively easy to fit the connecting pieces. Thus, the window 925 formed in the layer of corrugated sheet metal might similarly be able to interrupt the corrugations of which the directrix line, without actually cutting through the support leg, would be too close to the support leg to allow the connecting pieces to be fitted between them and the support leg.

The center of the support leg 910 is positioned between the directrix lines A of the interrupted corrugations 920 and between the directrix lines B of the interrupted corrugations 921 and, more specifically, in the middle of these directrix lines in FIG. 10. The result of this positioning is that the directrix line A or B each time intersects the support leg 910 along a chord that is shorter than the diameter of the support leg 910. As a result, and bearing in mind the space there needs to be between the edge of the window 925 and the support leg 910 in order to allow the connecting pieces to be fitted, this positioning of the support leg allows each of the corrugations 920 and 921 to be interrupted over a distance that is shorter than it would be if the directrix line A or B were to intersect the support leg along the greatest transverse dimension thereof, which means to say along the diameter thereof in the case of a circular cross section. It is advantageous for the corrugations in the sealing barrier to be interrupted over the shortest possible distance, given that these interruptions are liable locally to reduce the flexibility of the sealing barrier and therefore locally encourage fatigue and wear thereof.

In the case of a circular cross section, centering the support leg mid-way between the interrupted corrugations 920 and mid-way between the interrupted corrugations 921 offers an optimized result. However, other shapes of cross section and other positions of the leg may also be considered. One principle that may be of use each time in choosing the position of the support leg between the corrugations is to choose a position which minimizes or, at the very least reduces, the transverse dimension of the support leg that the directrix line of the interrupted corrugation intersects. If the particular geometry of the support leg and/or the particular distribution of the corrugations of the membrane entails interrupting several corrugations over different lengths, a relevant optimization parameter in selecting the positioning of the support leg may be the length of the longest interruption or the combined length of interruptions obtained.

In FIG. 10, the window 925 is square in shape making it easier to cut the sealed plates 911 to the desired shape. However, other shapes of window may also be used, notably depending on the geometry of the support leg. Other embodiments that can be employed for creating the primary sealed membrane around the support leg are described in FR-A-2961580.

In order to connect to the secondary sealing barrier, the support leg 910 comprises a secondary plate 923 of circular shape fixed around the frustoconical part 913 at a height corresponding to the upper surface of the secondary thermally insulating barrier 922 and of the secondary sealed barrier which is very thin. In order to connect to the primary sealing barrier, the support leg 910 comprises a primary plate 924 of round shape fixed around the frustoconical part 913 at a height corresponding to the upper surface of the primary thermally insulating barrier 926. The plates 923 and 924 may be produced as one with the support leg 910.

Under the secondary plate 923, the secondary insulating barrier 922 comprises a wad of glass wool 927 which also has a circular exterior contour. Under the primary plate 924, the primary insulating barrier 926 comprises a wad of glass wool 928 which likewise has a circular exterior contour.

Around the wad 927 and the plate 923, the secondary insulating barrier, the secondary sealing barrier and the primary insulating barrier are created by means of four corner panels. A panel takes the overall shape of L-shaped steps with an L-shaped lower insulating block constituting an element of the secondary insulating barrier, a sealed covering 932 completely covering the L-shaped upper surface of the block and an L-shaped upper insulating block of smaller dimension constituting an element of the primary insulating barrier. The upper block is aligned with the external sides of the lower block so as to leave a region of the sealed covering 932 situated on an interior rim and on end rims of the lower block 931 uncovered. The panel 930 can be prefabricated by bonding together materials similar to those taught in application FR-A-2781557, notably polyurethane foam and plywood for the insulating barriers and a composite material made of aluminum foil and fiberglass in the case of the secondary sealing barrier. How to create such an insulating barrier using panels is described in detail in patent FR-A-2961580.

The four corner panels 930 via their interior sides border the contour of the wad 927 and of the plate 923. The dimensions of the blocks 931 are designed to leave spaces between them in the form of four radial chimneys 934 each one situated between the end faces of two adjacent lower blocks 931. To ensure the continuity of the secondary insulating barrier 922, each of the chimneys 934 is packed with a sheet of fiberglass 935. The porosity of the fiberglass of the sheets 935 and of the wad 927 allows gas to circulate through the secondary insulating barrier 922, notably in order to inert the tank wall using nitrogen.

Figure 11:
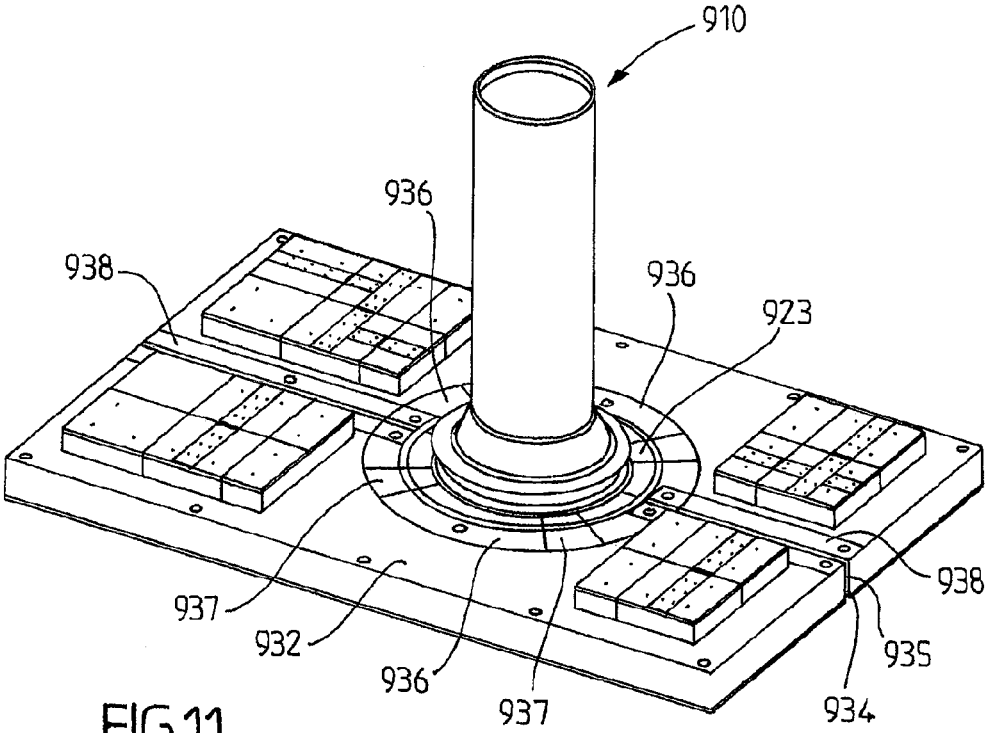
FIG. 11 is a perspective depiction of how sealing is achieved around a support leg.

FIG. 11 depicts how the secondary sealing barrier in the region of the support leg 910 is created. In order to create the continuity of the secondary sealing barrier around the support leg 910, four strip portions 936 of the sealed composite material made of aluminum foils and fiberglass and referred to as Triplex® are bonded to the secondary plate 923 and to the sealed covering 932 of the panels 930. Each sealed strip portion forms an arc of a circle which constitutes an annulus at the base of the leg once they have been assembled on the sealed covering 932. A strip portion 936 is positioned so that each straddles one side of the secondary plate 927 and the uncovered interior rims of two lower blocks 931. The strip portions 936 overlap one another at the end regions 937. To ensure the continuity of the secondary sealing barrier above the chimneys 935, four strips 938 of the sealed composite material made of aluminum foil and fiberglass are bonded to the sealed covering 932 of the panels 930, so that each one overlaps the end rims of two lower blocks 931.

The use of a circular plate 923 and of an annular strip makes it possible to reduce the stresses borne by the flexible strip 936 notably by eliminating the corner regions likely to concentrate the stresses. Stresses of thermal original appearing in the secondary membrane bonded at the junction with the support leg are notably dependent on the service temperature of this membrane when the tank is filled with liquefied gas. The greater the proportion of the total thickness of the tank wall that the secondary insulating barrier represents, the lower this temperature will be.

Figure 14:
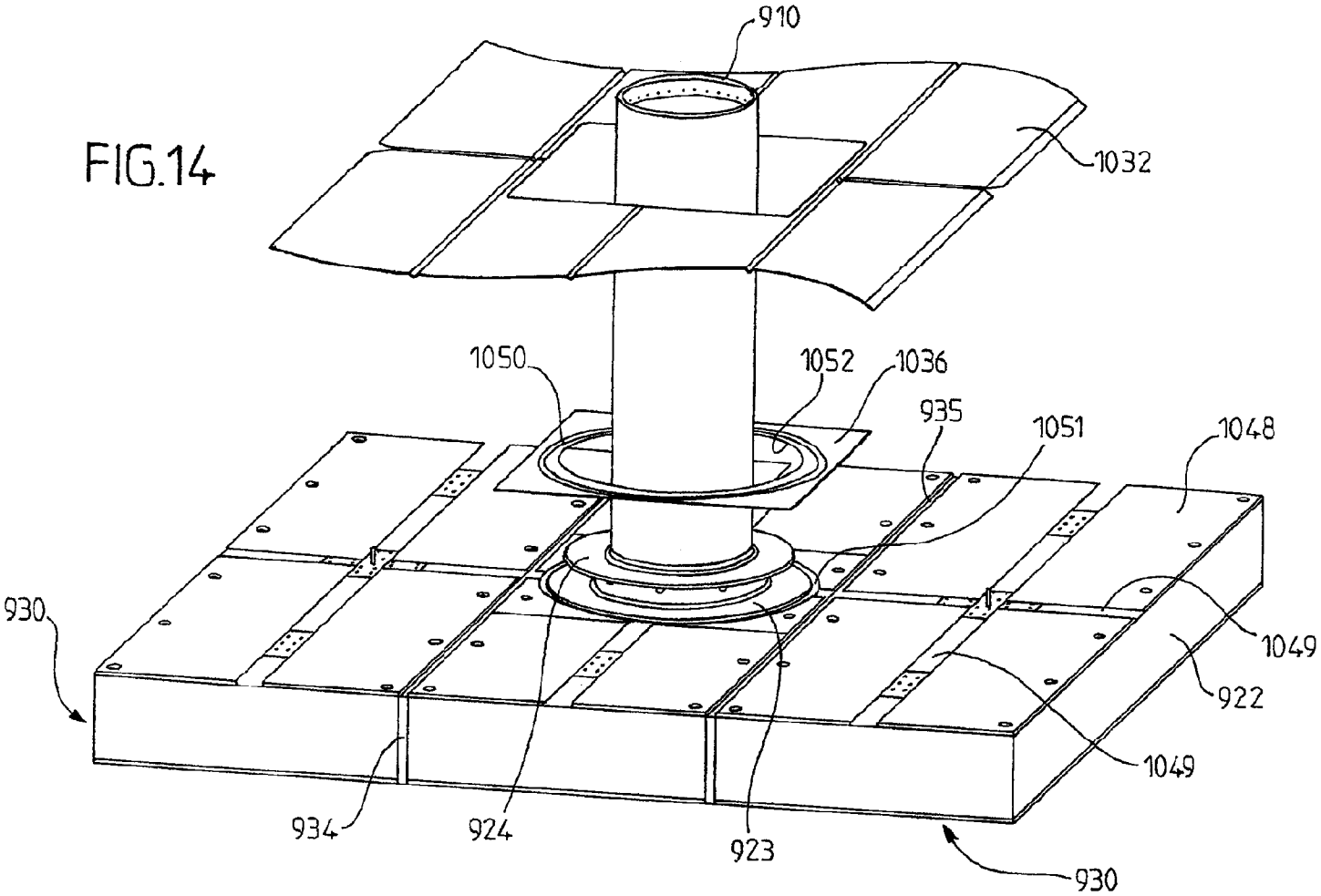
FIG. 14 is a perspective view of another embodiment of the sealing arrangement around a support leg of the invention.

Another embodiment of the sealing around a support leg 910, as an alternative to the embodiment of FIGS. 10 and 11, will be described with reference to FIG. 14.

In this embodiment, the support leg 910 is in every respect identical to the previous one and notably comprises a primary plate 924 and a secondary plate 923. The secondary insulating barrier 922 is made up of insulating panels 930. These panels 930 support the secondary sealed membrane 1032. The panels 930 comprise, in the plywood cover 1048, metal inserts 1049 forming regular parallel strips. These inserts 1049 are intended to hold the membrane 1032. Specifically, the membrane 1032 is made up of metallic strips of which the margins of adjacent strips overlap at the metal inserts to which they are welded in a sealed manner. The membrane 1032 is made of a metallic sheet metal made of a nickel steel alloy with a very low coefficient of expansion.

Arranged between this secondary sealed membrane 1032 and the secondary support plate 923 is a metal connecting layer 1036. This layer 1036 ensures the continuity of the sealing between the two elements. This layer 1036 partially covers the secondary plate 923 on the one hand. On the other hand, the layer 1036 is partially covered by the secondary sealed membrane 1032. In each instance, it is fixed in a sealed manner. This fixing is achieved for example using a welding method.

The layer 1036 is made from a metal sheet made of nickel steel alloy with a very low coefficient of expansion. The peripheral shape is that of a rectangle. It comprises a hole 1052 for the passage of the primary plate 924 while at the same time partially covering the secondary plate 923. It comprises a circular wave 1050. The wave 1050 forms a fold facing toward the secondary insulating barrier 922. The wave 1050 is arranged on the outside of the secondary plate 923 in line with a chimney 1051 at the periphery of the support leg 910 able to accommodate same. The peripheral chimney 1051 is filled with a mineral wool that can be compressed by the wave 1050. This wave 1050 forms an elastic region in the layer 1036. This elastic region is intended to absorb static and dynamic pressure loadings. It also provides the ability to absorb thermal contraction experienced by the secondary sealed barrier.

The tanks described hereinabove can be used in various types of facility such as on-shore facilities or in an off-shore structure such as a methane tanker or the like.

Figure 12:
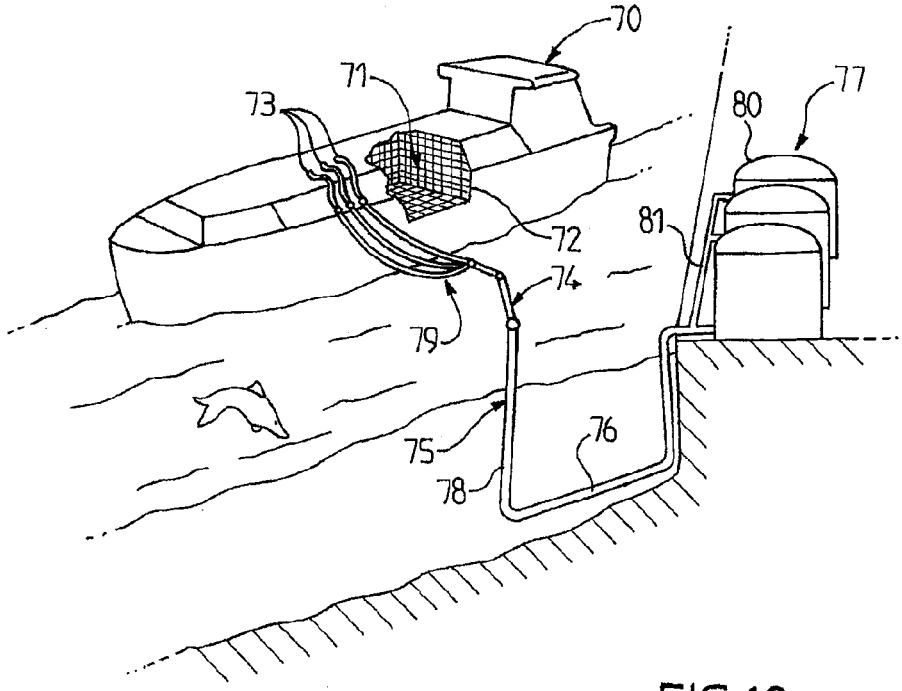
FIG. 12 is a schematic depiction with cutaway of a tank of a methane tanker and of a terminal for loading/offloading from this tank.

With reference to FIG. 12, a view with cutaway of a methane tanker 70 shows a sealed and insulated tank 71 of prismatic overall shape mounted in the double hull 72 of the ship. The wall of the tank 71 comprises a primary sealed barrier intended to be in contact with the LNG contained in the tank, a secondary sealed barrier arranged between the primary sealed barrier and the double hull of the ship, and two insulating barriers respectively arranged between the primary sealed barrier and the secondary sealed barrier and between the secondary sealed barrier and the double hull 72.

In a way known per se, loading/offloading pipelines arranged on the upper deck of the ship may be coupled, using suitable connectors, to a maritime or harbor terminal in order to transfer a cargo of LNG from or to the tank 71.

FIG. 12 depicts one example of a maritime terminal comprising a loading and offloading station 75, an underwater pipe 76 and an on-shore facility 77. The loading and offloading station 75 is a fixed offshore facility comprising a mobile arm 74 and a tower 78 supporting the mobile arm 74. The mobile arm 74 carries a bundle of insulated flexible pipes 79 which can be connected to the loading/offloading pipelines 73. The orientable mobile arm 74 adapts to suit all sizes of methane tanker. A connecting pipe, not depicted, extends along the inside the tower 78. The loading and offloading stations 75 allow the methane tanker 70 to be loaded or offloaded from or to the on-shore facility 77. The latter comprises liquefied gas storage tanks 80 and connecting pipes 81 connected by the underwater pipe 76 to the loading or offloading station 75. The underwater pipe 76 allows the liquefied gas to be transferred from the loading or offloading station 75 and the on-shore facility 77 over a long distance, for example 5 km, which makes it possible to keep the methane tanker 70 a long distance offshore during the loading and offloading operations.

In order to generate the pressure needed for transferring the liquefied gas, use is made of the pumps carried onboard the ship 70 and/or of the pumps with which the on-shore facility 77 is equipped and/or of the pumps with which the loading and offloading station 75 is equipped.

Although the invention has been described in conjunction with a number of particular embodiments it is quite obvious that it is not in any way restricted thereto and that it comprises all technical equivalents of the means described and combinations thereof where these fall within the scope of the invention.

The use of the verbs "comprise", "include" or "have" and the conjugated forms thereof does not exclude there being elements or steps other than those listed in a claim. The use of the indefinite article "a" or "an" for an element or a step does not, unless mentioned otherwise, exclude there being a plurality of such elements or steps.

In the claims, any reference sign placed between parentheses is not to be interpreted as imposing a limit on the claim.

The invention claimed is:

1. A sealed and thermally insulated tank arranged in a bearing structure (1) to contain a fluid, said tank comprising tank walls fixed to walls of said bearing structure, a tank wall having in succession, in the thickness direction from the inside toward the outside of said tank, a primary sealed barrier (3), a primary thermally insulating barrier (4), a secondary sealed barrier (5) and a secondary thermally insulating barrier (6), the tank further comprising a through element (7, 910) arranged through the tank wall, in which tank the tank wall around the through element comprises:

secondary insulating blocks arranged on the wall of the bearing structure around the through-element and forming the secondary thermally insulating barrier around the through element so that the through-element passes through the secondary thermally insulating barrier between said secondary insulating blocks, the secondary insulating blocks being covered by a first sealed layer forming the secondary sealed barrier, a plate (722, 923) arranged parallel to the tank wall having a surface facing toward the inside of the tank at the same level as the first sealed layer (17, 932) forming the secondary sealed barrier, the plate being connected in a sealed manner directly or indirectly to a peripheral wall of the through element all around the through-element, a second sealed layer (723, 936, 823, 1036) fixed in a sealed manner straddling the first sealed layer and the plate all around the plate in which tank the tank wall further comprises primary insulating elements arranged on the secondary sealed barrier around the through element and forming the primary thermally insulating barrier around the through element so that the through element passes through the primary thermally insulating barrier between the primary insulating elements, the primary insulating elements being covered by primary sealed barrier elements which are connected in a sealed manner to the peripheral wall of the through element so that the through element passes through the primary sealed barrier between the primary sealed barrier elements, characterized in that the plate (722, 923) is a circular plate having a circular exterior shape, and in that the second sealed layer comprises a circular window having a diameter smaller than the outside diameter of the circular plate, the secondary sealed barrier being passed through by the through element through the window of the second sealed layer.

2. The tank as claimed in claim 1, in which the second sealed layer comprises an annular strip (723, 936) which follows the circular exterior shape of the circular plate (722, 923), the circular window being delimited by an interior edge of the annular strip.

3. The tank as claimed in claim 2, in which the annular strip (723, 936) is made up of a plurality of sealed strip portions, each sealed strip portion (723*a*, 723*d*) forming an arc of a circle.

4. The tank as claimed in claim 3, in which the sealed strip portions (723*b*, 723*c*) overlap in pairs so as to form regions of overlap each one corresponding to a marginal portion of the length of the two sealed strip portions.

5. The tank as claimed in claim 1, in which the second sealed layer (823, 1036) comprises a metal foil having an annular fold (850, 1050) surrounding the circular window (1044, 1052) and arranged between the exterior diameter of the circular plate and the first sealed layer, the annular fold forming an expansion joint between said circular plate and said first sealed layer.

6. The tank as claimed in claim 5, in which the annular fold is oriented toward the secondary thermally insulating barrier, the annular fold being fitted into a peripheral chimney (1051) between the through-element and the secondary insulating blocks.

7. The tank as claimed in claim 5, in which the peripheral chimney (1051) is filled with a compressible insulator.

8. The tank as claimed in claim 1, in which the second sealed layer is bonded to the first sealed layer and the circular plate.

9. The tank as claimed in claim 1, in which the second sealed layer is welded to the first sealed layer and the circular plate.

10. The tank as claimed in claim 1, in which the through element is a support leg (910) for equipment immersed in the sealed tank, the support leg extending longitudinally through the tank wall and having a first end portion bearing against the wall of the bearing structure (1) and a second end portion projecting into the tank to support the equipment away from the layer of sheet metal, the circular plate being connected in a sealed manner to the peripheral wall of the support leg all around the support leg.

11. The tank as claimed in claim 10, in which the support leg passes through the primary sealed barrier in a window (925), said primary sealed barrier comprising connecting pieces arranged in the window around the support leg for connecting the support leg in a sealed manner to a marginal portion of the layer of corrugated sheet metal delimiting the window, said window interrupting the directrix lines (A, B) of a plurality of the parallel corrugations of said at least one series and the support leg is centered on a position situated between the directrix lines of two parallel corrugations of said plurality.

12. The tank as claimed in claim 10 or 11, in which the support leg is placed at the base of a tank offloading mast.

13. The tank as claimed in claim 1, in which the through element comprises a sealed pipe (7), the sealed pipes defining a passage between the interior space of the tank and a vapor manifold arranged on the outside of the tank.

14. The tank as claimed in claim 13, in which the tank wall around the sealed pipe further comprises:

a blanking plate (727) connected in a sealed manner to the periphery of the sealed pipe and extending parallel to the tank wall, the blanking plate being spaced toward the outside of the tank with respect to the secondary sealed barrier, a peripheral first connecting plate (21) fixed in a sealed manner to the entire periphery of the blanking plate (727) and running parallel to the sealed pipe (7), the first connecting plate extending in the thickness direction of the tank wall and forming a rim projecting toward the secondary sealed barrier with respect to the blanking plate, the secondary insulating blocks being arranged on the wall of the bearing structure around the peripheral first connecting plate, the circular plate (722) comprising a second connecting plate (26) fixed in a sealed manner to a surface of the circular plate that is oriented toward the blanking plate and projecting toward the bearing structure parallel to the sealed pipe (7), the second connecting plate being fixed in a sealed manner to the first connecting plate all around the first connecting plate, the two mutually spaced plates delimiting a housing, an opening (25) formed through the circular plate to allow gas to circulate between a primary space situated between the two sealing barriers and the housing, and a pipe opening through the blanking plate and extending toward the bearing structure to define a passage between the housing and the vapor manifold.

15. A ship (70) for transporting a cold liquid product, the ship having a double hull (72) and a tank (71) as claimed in claim 1 arranged in the double hull.

16. The use of a ship (70) as claimed in claim 15 for loading or offloading a cold liquid product, in which a cold liquid product is conveyed through insulated pipelines (73,

79, 76, 81) from or to an off shore or on-shore storage facility (77) to or from the tank of the ship (71).

17. A transfer system for a cold liquid product, the system comprising a ship (70) as claimed in claim 15, insulated pipelines (73, 79, 76, 81) arranged in such a way as to connect the tank (71) installed in the hull of the ship to an off shore or on-shore storage facility (77) and a pump for driving a stream of cold liquid product through the insulated pipelines from or to the off shore or on-shore storage facility to or from the tank of the ship.

* * * * *